US006527426B2

(12) United States Patent
Oyama et al.

(10) Patent No.: US 6,527,426 B2
(45) Date of Patent: Mar. 4, 2003

(54) VEHICLE LAMP

(75) Inventors: Hiroo Oyama, Sagamihara (JP); Go Adachi, Tokyo (JP); Masahito Okamoto, Kawasaki (JP); Yoshifumi Kawaguchi, Kawasaki (JP)

(73) Assignee: Stanley Electric Co., LTD, Tokyo (JP)

( * ) Notice: Subject to any disclaimer, the term of this patent is extended or adjusted under 35 U.S.C. 154(b) by 0 days.

(21) Appl. No.: 09/841,065

(22) Filed: Apr. 25, 2001

(65) Prior Publication Data

US 2001/0046138 A1 Nov. 29, 2001

(30) Foreign Application Priority Data

Apr. 26, 2000 (JP) ..... 2000-126373

(51) Int. Cl.[7] ..... F12V 7/00
(52) U.S. Cl. ..... 362/517; 362/298; 362/346
(58) Field of Search ..... 362/517, 518, 362/297, 346, 298

(56) References Cited

U.S. PATENT DOCUMENTS

2001/0026457 A1 * 10/2001 Oyama et al. ..... 362/517
2001/0046137 A1 * 11/2001 Oyama et al. ..... 362/517

FOREIGN PATENT DOCUMENTS

EP 0206908 * 12/1986
EP 1139009 * 4/2001
EP 1128124 * 8/2001
EP 1150061 * 10/2001
JP 2000-76907 3/2000
JP 2000-182411 6/2000

* cited by examiner

*Primary Examiner*—Thomas M. Sember
(74) *Attorney, Agent, or Firm*—Morgan, Lewis & Bockius LLP

(57) ABSTRACT

A vehicle light having a multi-reflex optical system can include a light source, at least one pair of ellipse group reflecting surfaces located so as to substantially surround the light source. Each ellipse group reflecting surface can be symmetrical relative to the light source and have a first focus in the vicinity of the light source, a second focus, and a longitudinal axis perpendicular to an optical axis of the vehicle light. The same number of parabolic group reflecting surfaces as the ellipse group reflecting surfaces can be located substantially linearly, with each parabolic group reflecting surface having a focus on the second focus of the corresponding ellipse group reflecting surface and a longitudinal axis substantially parallel to the optical axis of the vehicle light. At least one shade can be located in the vicinity of one of the second foci of the ellipse group reflecting surfaces to provide a predetermined shape to luminous flux directed from the corresponding ellipse group reflecting surface.

19 Claims, 4 Drawing Sheets

VEHICLE LAMP

This invention claims the benefit of Japanese Patent Application No. 2000-126373, filed on Apr. 26, 2000, which is hereby incorporated by reference.

BACKGROUND OF THE INVENTION

1. Field of the Invention

The present invention relates to a vehicle lamp for use in the illumination of a headlamp, fog lamp etc., and more particularly relates to a vehicle lamp that is thin and can form light distribution characteristics in a multi-reflex manner using an ellipse group reflector and a parabolic group reflector with high utilization efficiency of light emitted from a light source.

2. Description of the Related Art

FIG. 7 shows a conventional vehicle headlight 90 including a parabolic group reflecting surface such as a rotated parabolic surface. FIG. 8 shows another conventional vehicle headlight 80 including an ellipse group reflecting surface such as a rotated elliptic surface.

The conventional vehicle headlight 90 includes a first light source 91 such as a filament of an incandescent lamp, a parabolic group reflecting surface 92 such as a rotated parabolic surface having a focus located at the back of the first light source 91 and a rotation axis on an optical axis X (i.e., an illumination direction of the conventional headlight 90), a front lens 93 covering an aperture of the parabolic group reflecting surface 92 and having prismatic cuts 93*a* on its inner surface, and a shade 91*a* for formation of the low beam light distribution pattern. Since the first light source 91 is located in front of the focus of the parabolic group reflecting surface 92, light reflected by an upper half of the reflecting surface 92 is directed downward. The shade 91*a* covers a lower half of the light source 91 to prohibit unnecessary upwardly directed light rays from being reflected by a lower half of the parabolic group reflecting surface 92. A portion of upwardly directed light rays is required to illuminate the road side for and lighting road signs and/or pedestrians. In the case where the vehicle is driven in the left lane, the shape and location of the shade 91*a* are adjusted so as not to prohibit a predetermined portion of light rays which are to illuminate the upper left front view from the vehicle while prohibiting other portions of the upwardly directed light rays.

The vehicle headlight 90 further comprises a second light source 94 for the high beam light distribution pattern located substantially on the focus of the parabolic group reflecting surface 92. No shade is arranged for the second light source 94. A light distribution pattern of the vehicle headlight 90 is changed by switching the light source between the first light source 91 and the second light source 94.

The conventional vehicle headlight 80 can be referred to as a projection-type headlight 80 and comprises an ellipse group reflecting surface 82 such as a rotated elliptic surface having a first focus and a second focus, a light source 81 on the first focus, a shading plate 84 in the vicinity of the second focus, and a projection lens 83 having its focus in the vicinity of the second focus. The projection lens 83 has a convex lens on the front side, and a planar surface on the rear side relative to an optical axis X of the vehicle headlight 80. Light reflected by the ellipse group reflecting surface 82 converges to the second focus. An image of the luminous flux at the second focus is projected upside-down in the illumination direction X by the projection lens 83. On formation of low-beam mode light distribution pattern, the shading plate 84 prohibits a substantial lower half portion of luminous flux that converges at the second focus. The prohibited luminous flux would have been upwardly directed light rays after being projected by the projection lens 83. Accordingly, the image of luminous flux at the second focus has, in a cross section, a substantial upper chord located in an upper half of a circle. The image of the substantial upper chord is reversed upside-down when the luminous flux passes through the projection lens 83. Thus, the vehicle headlight 80 provides a low-beam mode light distribution pattern that does not include upwardly-directed light rays.

More specifically, the shading plate 84 prohibits not all of, but an unnecessary portion of, a lower half of the luminous flux at the second focus. A portion of the lower half of the luminous flux at the second focus which is to be upwardly directed light rays after passing through the projection lens 83 is permitted passageway to illuminate a road side. In the case where the vehicle is driven in the left lane, the shape and location of the shading plate 84 are adjusted so as not to prohibit a predetermined portion of the lower half of luminous flux at the second focus that illuminates the upper left front view from the vehicle after passing through the projection lens 83, while prohibiting other portions of the lower half of luminous flux at the second focus. When the vehicle headlight 80 changes its light distribution pattern mode from low-beam to high-beam, the shading plate 84 is moved away from luminous flux converged at the second focus. In the conventional projection-type vehicle headlight 80, the shading plate 84 is located perpendicular to the optical axis X of the ellipse group reflecting surface 82.

Conventional vehicle headlights 90 and 80 have at least the following problems. First, the conventional vehicle headlights 90 and 80 respectively include a shade 91*a* and shading plate 84. The shade 91*a* and shading plate 84 respectively prohibit substantially half of the total light amount emitted from the first light source 91 and light source 81. Therefore, utilization efficiency of light emitted from the first light source 91 and light source 81 in low-beam mode is small, giving the impression that the vehicle headlights 90 and 80 are dark in comparison with light amounts emitted from the first light source 91 and light source 81, respectively.

The conventional vehicle headlights 90 and 80 also have restricted design flexibility. From a view point of automobile body design, it is preferable for the vehicle headlights 90 and 80 to have a large width and a small height in front view. In the conventional vehicle headlight 80, it is possible to have a smaller height. However, it is difficult, if not impossible, to have a larger width. In the conventional vehicle headlight 90, there exits a limit to which the height of the headlight can be reduced while satisfying functional requirements of the headlight. Reduction of the height also results in decreasing utilization efficiency of lumen output by the parabolic group reflecting surface 92. Accordingly, it is difficult to greatly change the current design of the conventional vehicle headlights 90 and 80.

SUMMARY OF THE INVENTION

In order to solve the aforementioned problems in the related art, in the present invention, a vehicle light can include a light source, at least a pair of ellipse group reflecting surfaces configured to symmetrically surround the light source. Each ellipse group reflecting surface can have a first focus located on the light source, and can have a longitudinal axis that is perpendicular to an optical axis of the vehicle light. The same number of parabolic group reflecting surfaces as ellipse group reflecting surfaces can be located substantially linearly so as to cause light rays to be directed in predetermined directions from the vehicle light. Each parabolic group reflecting surface can have a focus located substantially on the second focus of one of the ellipse group reflecting surfaces, and can have an optical axis that is substantially parallel to the optical axis of the vehicle light. A shading plate can be located in the vicinity of the second focus of one of the ellipse group reflecting surfaces for providing a predetermined shape to luminous flux that converges from the ellipse group reflecting surface.

In accordance with another aspect of the invention, a vehicle lamp having a multi-reflex optical system and an optical axis can include a light source, an ellipse group reflecting portion configured to substantially surround the light source, a parabolic group reflecting portion having a focus on the second focus of the ellipse group reflecting portion, and a shade located in the vicinity of a second focus of the ellipse group reflecting portion to provide a predetermined shape to luminous flux directed from the ellipse group reflecting portion. The ellipse group reflecting portion can be substantially symmetrical relative to the light source and can have a first focus in the vicinity of the light source and a second focus. A longitudinal axis of the ellipse group reflecting portion is preferably substantially perpendicular to the optical axis of the vehicle lamp, and a longitudinal axis of the parabolic group reflecting portion can be substantially parallel to the optical axis of the vehicle lamp.

In accordance with yet another aspect of the invention, a vehicle lamp can include a light source, an ellipse group reflecting portion configured to substantially surround the light source, a parabolic group reflecting portion having a focus on the second focus of the ellipse group reflecting portion, and means located in the vicinity of the second focus of the ellipse group reflecting portion for providing a predetermined shape to luminous flux directed from the ellipse group reflecting portion. The means for providing a predetermined shape can include a shade, a movable shade, and/or other mechanism for shaping luminous flux in a predetermined shape. The ellipse group reflecting portion can be located substantially within the parabolic group reflecting portion and form a chamber from which light from the light source is directed to the parabolic group reflecting portion such that light is then directed parallel to the optical axis of the vehicle lamp.

DETAILED DESCRIPTION OF THE PREFERRED EMBODIMENTS

Figure 1:
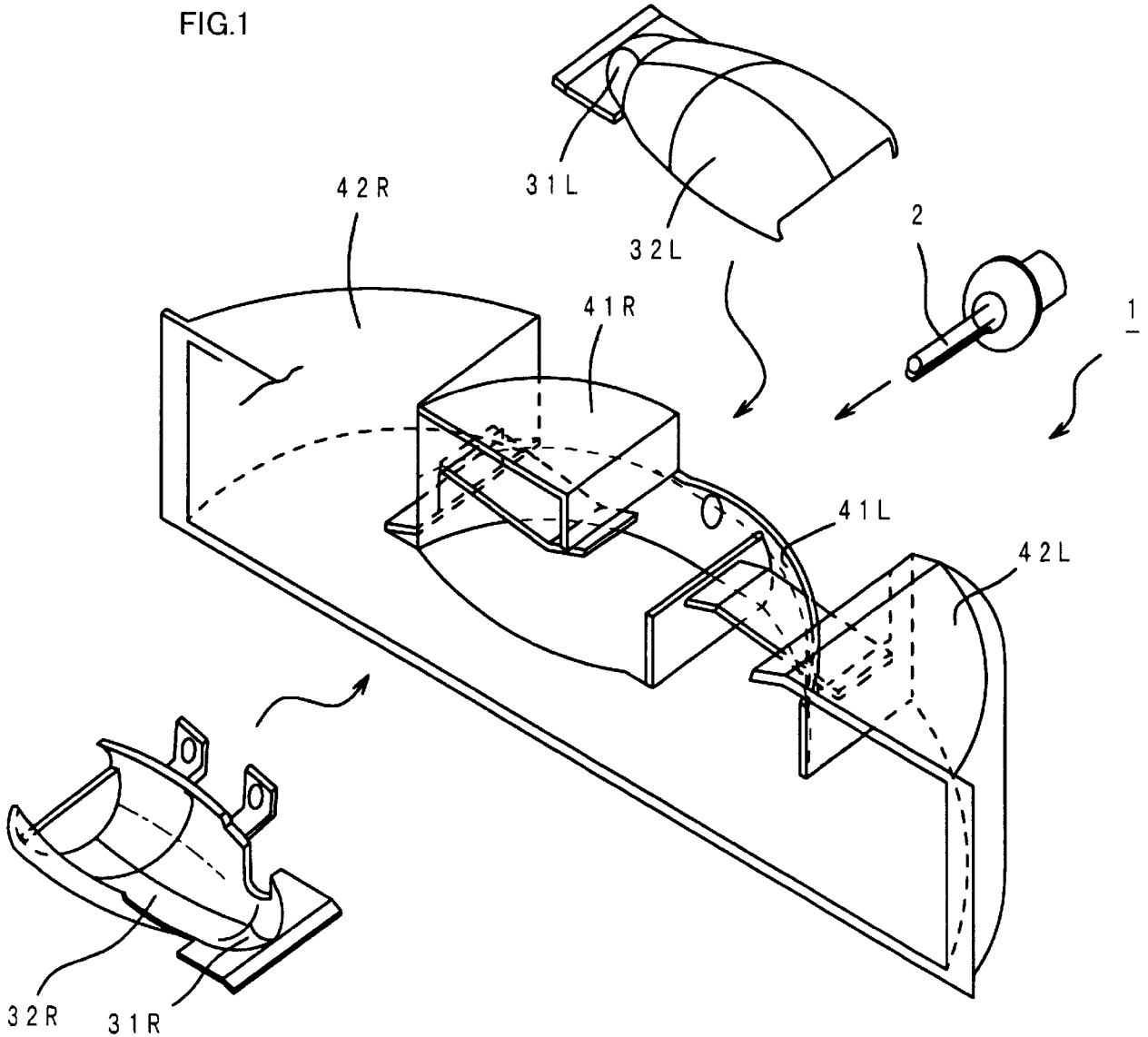
FIG. 1 is an exploded perspective view of a vehicle light having a multi reflex system according to a preferred embodiment of the invention.
Figure 2:
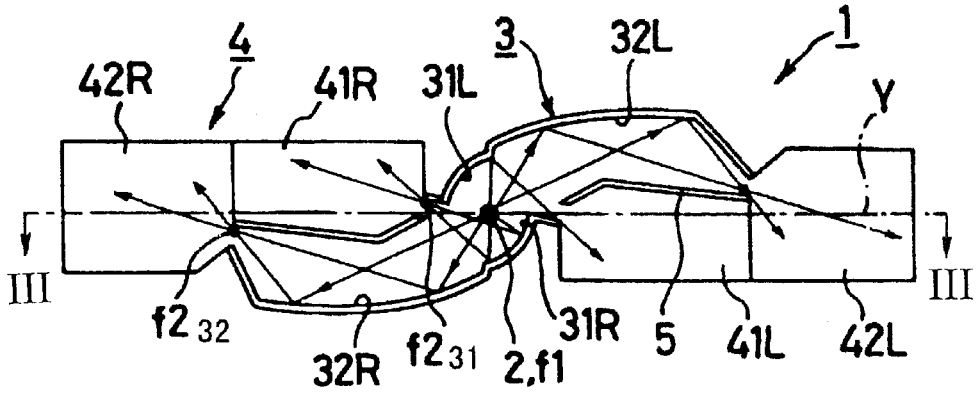
FIG. 2 is a front cross-sectional view along a longitudinal axis Y of an ellipse group reflecting surface 3 illustrating positional relationships of each reflecting surfaces of the vehicle light of FIG. 1.
Figure 3:
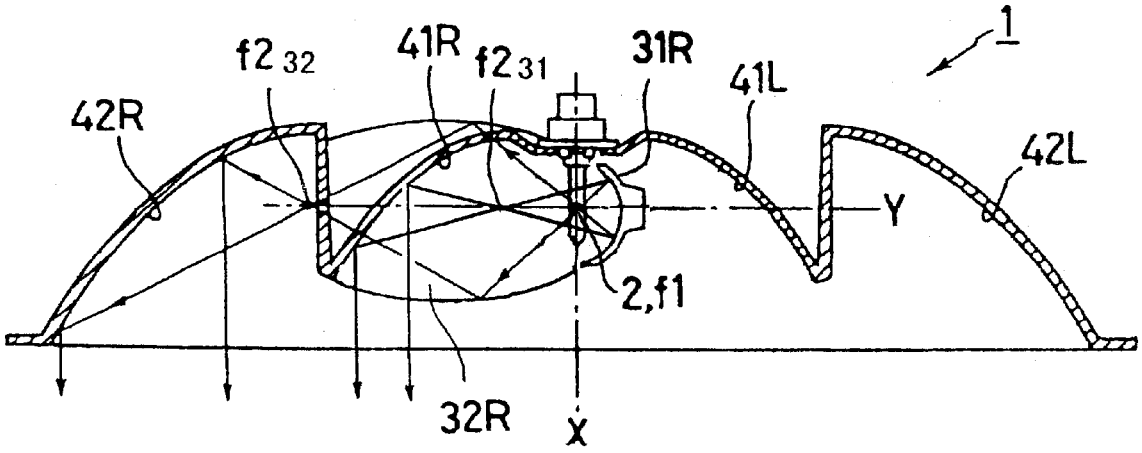
FIG. 3 is a top cross-sectional view along line III—III cross section of FIG. 2 without a shading plate.

Detailed description of the present invention will now be given based on embodiments shown in the drawings. Whenever possible, the same reference numbers are used throughout the drawings to refer to the same or like parts. FIGS. 1–3 show a vehicle light 1 having a multi-reflex system according to a preferred embodiment of the invention. FIGS. 1–3 are simplified views for facilitating the understanding of parts of the invention.

The vehicle light 1 can include a light source 2, an ellipse group reflecting surface 3 for collecting light rays which preferably includes a pair of ellipse group reflecting surface elements (31L, 31R) and (32L, 32R), a parabolic group reflecting surface 4 for directing light rays into predetermined directions from the vehicle light 1 and which can include the same number of parabolic group reflecting surface elements 41L, 41R, 42L, and 42R as the ellipse group reflecting surface elements 31L, 31R, 32L, and 32R. Each second focus $f2_{31}$ and $f2_{32}$ of the ellipse group reflecting surface element 31L, 31R, 32L, and 32R can be located in the vicinity of each focus of the corresponding parabolic group reflecting surface element 41L, 41R, 42L, and 42R.

The light source 2 may be any conventional type of lamp such as a halogen lamp incandescent lamp or high-intensity discharge lamp. However, when the halogen lamp is used, a single filament, hood-free type should be adopted. When the high-intensity discharge lamp is used, the D2S type which is free from any black stripe on a glass-envelope should be adopted.

General characteristics of the ellipse group reflecting surface and the parabolic group reflecting surface is described as follows. The ellipse group reflecting surface can include a curved surface having an ellipse or its similar shape as a whole, such as a rotated elliptic surface, a complex elliptic surface, an ellipsoidal surface, an elliptical free-curved surface, or combination thereof. If a light source is located on a first focus of the ellipse group reflecting surface, light rays emitted from the light source converge to a second focus of the ellipse group reflecting surface. The parabolic group reflecting surface can be defined as a curved surface having a parabola or similar shape as a whole, such as a rotated parabolic surface, a complex parabolic surface, paraboloidal surface, a parabolic free-curved surface, or combination thereof. Light rays emitted from a light source located on a focus of the parabolic group reflecting surface are reflected to be parallel to the axis of the parabolic group reflecting surface.

In the vehicle light 1, among the at least one pair of ellipse group reflecting surface elements, a first pair of ellipse group reflecting surface elements (31L, 31R) located closer to the light source 2 than the other pair can be referred hereinafter as the first ellipse group reflecting surface elements 31L, 31R. A second pair of ellipse group reflecting surface elements (32L, 32R) located farther from the light source 2 than the first pair can be referred hereinafter as the second ellipse group reflecting surface elements 32L, 32R. Among the parabolic group reflecting surface elements, the parabolic group reflecting surface elements 41L, 41R corresponding to the first pair of ellipse group reflecting surface elements (31L, 31R) can be referred hereinafter as the first pair of parabolic group reflecting surface elements (41L, 41R). The parabolic group reflecting surface elements 42L, 42R corresponding to the second pair of ellipse group reflecting surface elements (32L, 32R) can be referred hereinafter as the second pair of parabolic group reflecting surface elements (42L, 42R).

The ellipse group reflecting surface elements 31L, 31R, 32L and 32R can include a rotated elliptic surface and have a common-longitudinal axis Y approximately perpendicular to an optical axis X of the vehicle light 1 and can have a common first focus f1 on the light source 2. The ellipse group reflecting surface 3 is located such that it substantially surrounds the perimeter of the light source 2 when respective ellipse group reflecting surface elements 31L, 31R, 32L and 32R are combined together. The first pair of ellipse group reflecting surfaces 31L and 31R can be symmetrical relative to the light source 2. The second pair of ellipse group reflecting surfaces 32L and 32R can be symmetrical relative to the light source 2.

In the above-described configuration of the light source 2 and the ellipse group reflecting surface 3, substantially all light rays emitted from the light source 2 are reflected by the ellipse group reflecting surface 3, i.e., the first ellipse group reflecting surface elements 31L and 31R and the second ellipse group reflecting surface elements 32L and 32R, in directions towards the respective second foci $f2_{31}$ and $f2_{32}$ of the first and second ellipse group reflecting surface elements 31L, 31R, 32L, and 32R. The number of pairs of tie ellipse group reflecting surface elements (31L, 31R) and (32L, 32R) is not limited to two, and may include more or less than a pair of ellipse group reflecting surfaces (31L, 31R) or (32L, 32R).

The parabolic group reflecting surface 4, which can be a rotated parabolic reflecting surface, includes the same number of parabolic group reflecting surface elements 41L, 41R, 42L and 42R as the ellipse group reflecting surface elements 31L, 31R, 32L, and 32R. The parabolic group reflecting surface elements 41L, 41R, 42L and 42R can be arranged respectively corresponding to the ellipse group reflecting surface elements 31L, 31R, 32L, and 32R. Each focus of the parabolic group reflecting surface elements 41L, 41R, 42L and 42R is preferably located substantially on respective second foci $f2_{31}$ and $f2_{32}$ of the corresponding ellipse group reflecting surface 31L, 31R, 32L, and 32R. Each axis of the parabolic group reflecting surface elements 41L, 41R, 42L and 42R is preferably substantially parallel to the optical axis X of the vehicle light 1.

In the vehicle light 1, since the ellipse group reflecting surface 3 preferably includes two pairs of ellipse group reflecting surface elements (31L, 31R) and (32L, 32R), the parabolic group reflecting surface 4 preferably includes two pairs of parabolic group reflecting surface elements (41L, 41R) and (42L, 42R). Since substantially all light rays emitted from the light source 2 converge to the respective second foci $f2_{31}$ and $f2_{32}$ of the ellipse group reflecting surface elements 31L, 31R, 32L, and 32R with each second focus $f2_{31}$ and $f2_{32}$ located on a respective focus of each corresponding parabolic group reflecting surface element 41L, 41R, 42L, and 42R, light rays that are emitted from the light source 2 and reflected by the ellipse group reflecting surface 3 can be used very efficiently for formation of light distribution patterns of the vehicle light 1.

The locations of the respective pairs of the ellipse group reflecting surface elements (31L, 31R) and (32L, 32R) and parabolic group reflecting surface elements (41L, 41R) and (42L, 42R) can be varied for flexibility in design. In the vehicle light 1, the two pairs of parabolic group reflecting surface elements (41L, 41R) and (42L, 42R), totaling four parabolic group reflecting surface elements, can be arranged in a horizontal line. The focal distance between the first focus f1 and the second focus $f2_{31}$ of the first pair of ellipse group reflecting surface elements (31L, 31R) and the focal distance between the first focus f1 and the second focus $f2_{32}$ of the second pair of ellipse group reflecting surface elements (32L, 32R) can be adjusted such that each second focus $f2_{31}$ and $f2_{32}$ is located substantially on the focus of the corresponding parabolic group reflecting surface element 41L, 41R, 42L, or 42R.

The basic configuration of the vehicle light 1 of a preferred embodiment is described above. The ellipse group reflecting surface 3 causes light rays to converge at the respective second foci $f2_{31}$ and $f2_{32}$ of the ellipse group reflecting surface elements 31L, 31R, 32L, and 32R. Each parabolic group reflecting surface element 41L, 41R, 42L, 42R directs the light rays that have converged at its focus from each coresponding ellipse group reflecting surface elements 31L, 31R, 32L, and 32R to an illumination direction substantially parallel to the optical axis of the vehicle light 1.

The vehicle light 1 can further include a shading plate 5 in the vicinity of the respective second foci of the ellipse group reflecting surface elements 31L, 31R, 32L, and 32R. The shading plate 5 provides a desired shape to a cross-section image of luminous flux that converges at the second foci $f2_{31}$ and $f2_{32}$ such that the image of luminous flux after being reflected by the corresponding parabolic group reflecting surface 41L, 41R, 42L, or 42R is appropriate for formation of a desired light distribution pattern, such as a low-beam mode light distribution pattern.

In the vehicle light 1, the shading plate 5 is located nearly parallel to the longitudinal axis Y of the ellipse group reflecting surface 3. The shading plate 5 can be configured differently for distributing light differently from each of the ellipse group reflecting surfaces 31L, 31R, 32L and 32R. Since the second foci $f2_{31}$, $f2_{32}$ of the first and second ellipse group reflecting surface elements (31L, 32L) and (31R, 32R) on the same left or right side of the vehicle light 1 are close to each other, the shading plates for the first and second ellipse group reflecting surface elements on the same side (31L, 32L) and (31R, 32R) can be formed as a respective single unit on either side.

The shading plate 5 may include one or more reflecting films in the vicinity of one of the second foci $f2_{31}$, $f2_{32}$ of the ellipse group reflecting surface elements 31L, 31R, 32L, and 32R and on a surface facing to the ellipse group reflecting surface element 32L and/or 32R. The films can be located such that light rays prohibited by the shading plate 5 are reflected by the reflecting film toward either one of the reflecting surface elements 31L, 31R, 32L, 32R, 41L, 41R, 42L and 42R. The light rays reflected by the reflecting film towards the ellipse group reflecting surface elements 31L, 31R, 32L and/or 32R are again reflected and directed to the parabolic group reflecting surface elements 41L, 41R, 42L and/or 42R. The reflecting film can be formed by aluminum evaporation.

The operational advantages of the present invention will now be described. First, the lighting efficiency of the lamp is increased because the first and second pairs of ellipse group reflecting surface elements (31L, 31R) and (32L, 32R) surround substantially all of the perimeter of the light source 2. This configuration permits light rays to converge at the respective second foci $f2_{31}$ and $f2_{32}$ of the ellipse group reflecting surface elements 31L, 31R 32L, and 32R and be guided outside of the first and second pairs of ellipse group reflecting surface elements (31L, 31R) and (32L, 32R) toward the respective corresponding parabolic group reflecting surface elements 41L, 41R, 42L, or 42R. Thus, the amount of light rays reflected by the ellipse group reflecting surface 3 and the parabolic group reflecting surface 4 is approximately 60% of the total light amount emitted from the light source 2 in the low-beam mode light distribution pattern, which is substantially twice that of conventional vehicle headlights. When the same light source 2 as used in the conventional vehicle headlights 90 and 80 is used in the vehicle light 1, the vehicle light 1 is much brighter than the conventional vehicle headlights 90 and 80 and achieves superior visibility.

The ellipse group reflecting surface 3 can be divided into a predetermined number of ellipse group reflecting surface elements 31L, 31R, 32L, and 32R, which enable light rays emitted from the light source 2 to be divided and form a predetermined number of second foci $f2_{31}$ and $f2_{32}$. The parabolic group reflecting surface 4 can be divided into the same number of parabolic group reflecting elements 41L, 41R, 42L, and 42R as the ellipse group reflecting elements 31L, 31R, 32L, and 32R In the vehicle light 1, the parabolic group reflecting surface 4 can be divided into four reflecting surface elements, i.e., the parabolic group reflecting surface elements 41L, 41R, 42L and 42R, respectively corresponding to each second focus $f2_{31}$ and $f2_{32}$ of the ellipse group reflecting surface elements 31L, 31R, 32L, and 32R. Each parabolic group reflecting element 41L, 41R, 42L and 42R can have a small reflecting area and a small depth in a direction along the illumination direction of the vehicle light 1. If the vehicle light 1 is provided the same area in front view, as the conventional vehicle headlights 90 and 80, the depth of the vehicle light 1 would be much smaller than that of the conventional vehicle headlights 90 and 80. Further, since the divided parts of the parabolic group reflecting surface 4, i.e., the parabolic group reflecting surface elements 41L, 41R, 42L, and 42R, can be arranged in a horizontal line, the vehicle light 1 can have a large aspect ratio with a large width and a small height as viewed from the front, without any significant amount of light loss, which has not been achieved by the conventional vehicle headlights 90 and 80. The large aspect ratio of the vehicle light 1 is specifically appropriate for currently fashionable automobile bodies of aerodynamic style.

The shading plates 5 that can be located at respective second foci $f2_{31}$ and $f2_{32}$ of the ellipse group reflecting surface elements 31L, 31R, 32L, and 32R are able to provide an optimized shape to luminous flux at the corresponding second foci $f2_{31}$ and $f2_{32}$ This luminous flux travels to the corresponding parabolic group reflecting surface element 41L, 41R, 42L or 42R without requiring a shade or a black-stripe for the light source 2 to be utilized in order to form a low-beam light distribution pattern. This advantage also provides larger utilization efficiency of light emitted from the light source 2, thereby providing a brighter vehicle light 1.

Figure 4:
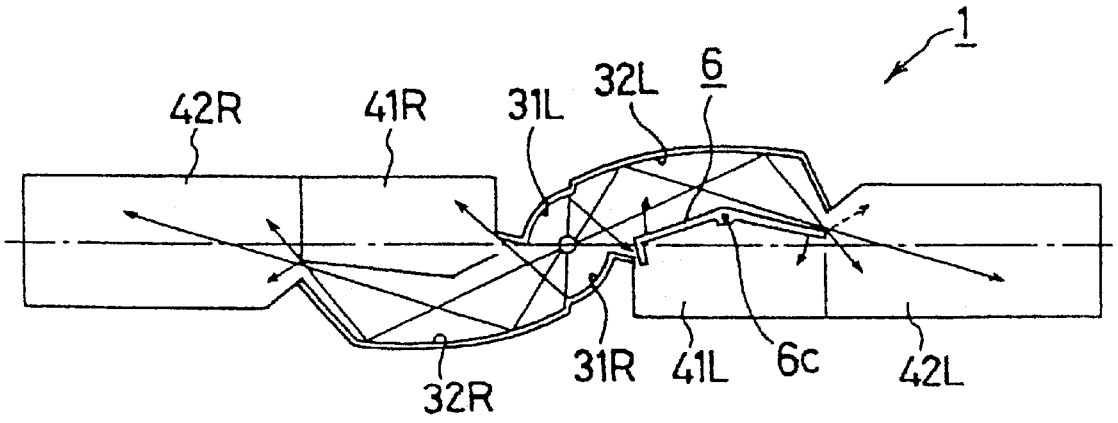
FIG. 4 is a partial cross-sectional front view illustrating positional relationships of reflecting surfaces of a vehicle light according to another preferred embodiment of the invention, the portion corresponding to the ellipse group reflecting surface being a cross-sectional view along a longitudinal axis of the ellipse group reflecting surface.
Figure 5:
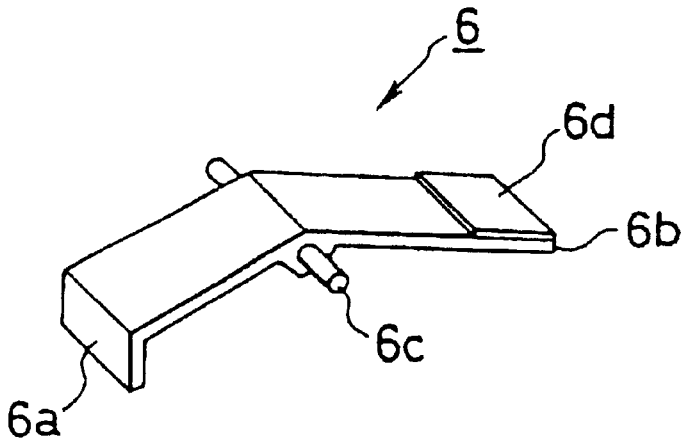
FIG. 5 is a perspective view illustrating a movable shading plate of the vehicle light of FIG. 4.
Figure 6:
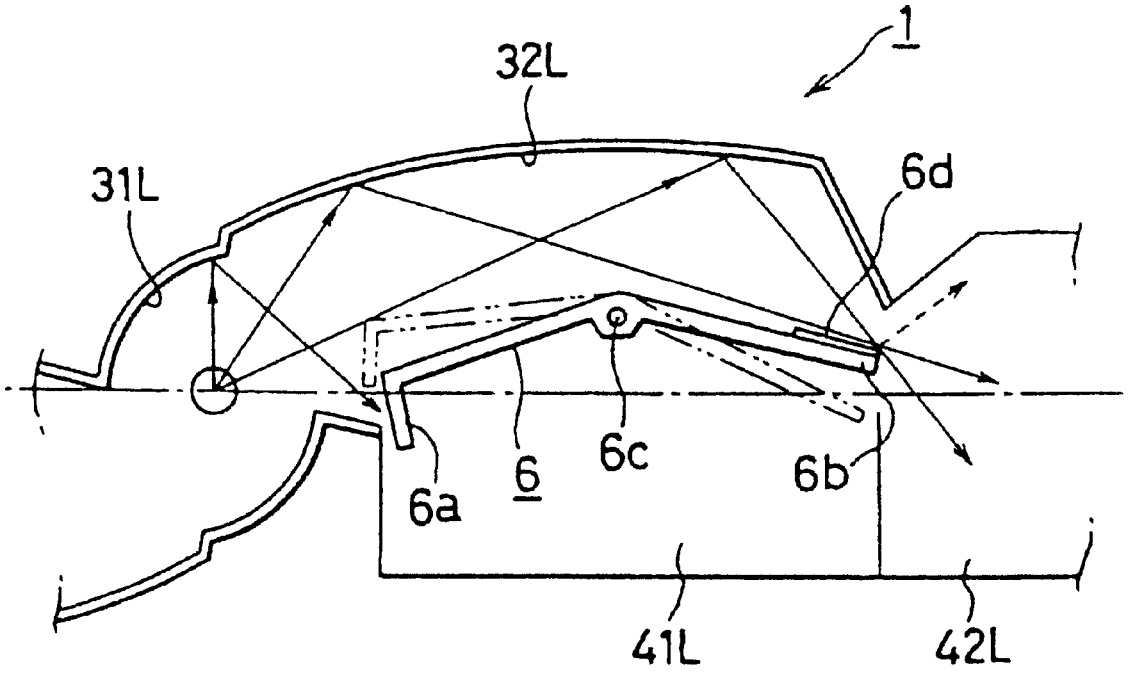
FIG. 6 is a partial perspective view illustrating states of operation of the movable shading plate of the vehicle light of FIG. 4.
Figure 7:
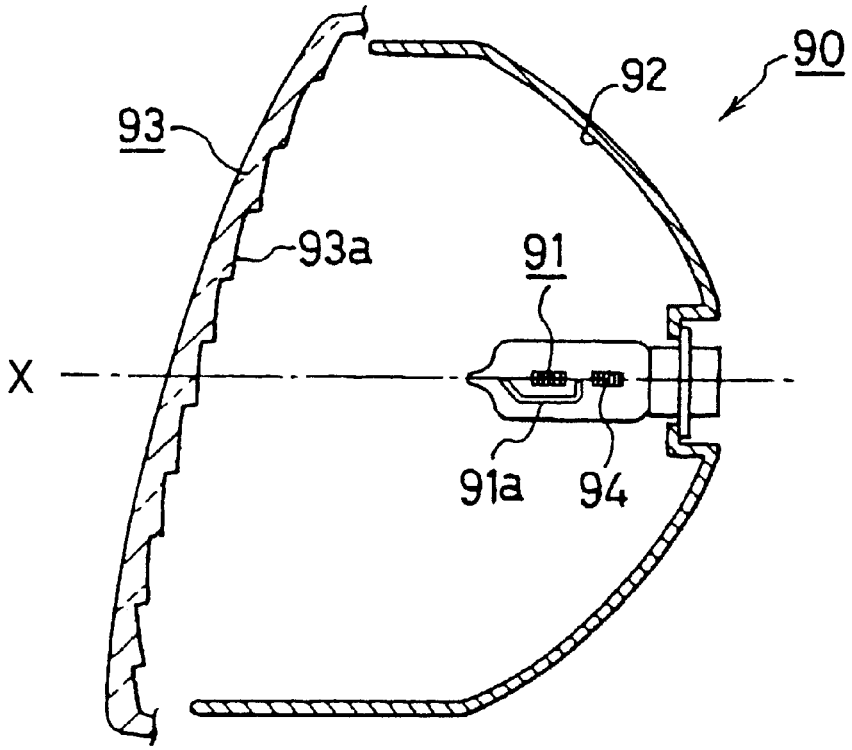
FIG.7 CONVENTIONAL ART
FIG. 7 is a cross-sectional view of a conventional vehicle headlight.
Figure 8:
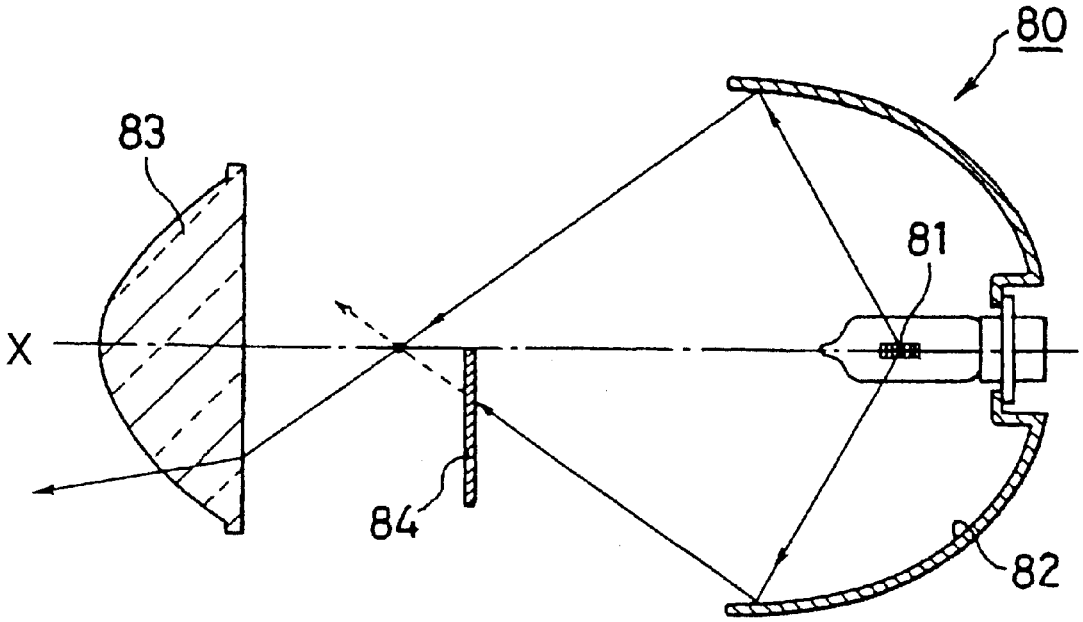
FIG.8 CONVENTIONAL ART
FIG. 8 is a cross-sectional view of another conventional vehicle headlight.

FIGS. 4–6 illustrate another preferred embodiment of the present invention. In the preferred embodiment shown in FIGS. 1–3, the light distribution mode obtained by a single vehicle light 1 is substantially limited to either a low-beam or high-beam. Therefore, it is preferable to arrange each vehicle light 1 of FIGS. 1–3 for a single light distribution mode. However, in such an automobile headlight, the use of two vehicle lights 1 (one for low-beam mode and one for high-beam mode) results in a cost increase. The cost problem is significant when a high-intensity discharge lamp is used as the light source 2 because the high-intensity discharge lamp uses an igniter and a control circuit, each exclusively used for the discharge lamp. Thus, another preferred embodiment provides a vehicle light 1 that includes a. single light source 2 that is also capable of changing light distribution mode.

FIG. 4 illustrates a partial cross-sectional front view of another preferred embodiment of the present invention. The portion corresponding to the ellipse group reflecting surface 3 is a cross-sectional view along a longitudinal axis of the ellipse. FIG. 5 illustrates the movable shading plate 6 as shown in FIG. 4. The movable shading plate 6 can include a first shading portion 6*a* corresponding to the first parabolic group reflecting surface element 41L, a second shading portion 6*b* corresponding to the second parabolic group reflecting surface element 42L, and a rotation axis 6*c*. The first shading portion 6*a* and the second shading portion 6*b* respectively prohibit unnecessary portions of light rays that converge at the respective focus of the first parabolic group reflecting surface element 41L and the second parabolic group reflecting surface element 42L, for forming the light distribution pattern of the vehicle light 1. The first shading portion 6*a* and the second shading portion 6*b* can be formed as a single unit corresponding to the parabolic group reflecting surface elements 41L and 42L and located on the left side of the vehicle light 1 relative to the optical axis X of the vehicle light 1. The rotation axis 6*c* can be located substantially in the middle of the single unit 6, and the first and second shading portions 6*a* and 6*b* move like a seesaw.

FIG. 6 illustrates states of operation of the movable shading plate 6. When the vehicle light 1 is in the low-beam mode light distribution pattern, the movable shading plate 6 takes a position indicated by solid lines. In the low-beam mode position, the first shading portion 6*a* prohibits substantially all light rays directed from the first ellipse group reflecting surface element 31L towards the first parabolic group reflecting surface element 41L. At this time, a portion of the second shading portion 6*b* is located in the luminous flux at the second focus of the second ellipse group reflecting surface element 32L. In this position, shading portion 6*b* prohibits light that would be upwardly directed after being reflected by the second parabolic group reflecting surface element 42L.

Accordingly, substantially no light rays are radiated from the first parabolic group reflecting surface element 41L, and downwardly directed light rays are radiated only from the second parabolic group reflecting surface element 42L. Thus, a low-beam mode light distribution pattern of the vehicle light 1 can be obtained. In addition, the shading plate 6 may further include a reflecting film 6*d* in the vicinity of the second shading portion 6*b* as shown in FIG. 5. The reflecting film 6*d* is located such that light rays prohibited by the second shading portion 6*b* are directed by reflecting film 6*d* to either the second ellipse group reflecting surface element 32L or the second parabolic group reflecting surface element 42L. Light rays reflected by the reflecting film 6*d* towards the second ellipse group reflecting surface element 32L are again reflected by the second ellipse group reflecting surface element 32L, and directed to the second parabolic group reflecting surface element 42L. Accordingly, light rays prohibited by the second shading plate 6*b* are not wasted. On formation of the high beam light distribution pattern, the shading plate 6 takes its high-beam mode position as shown by dotted lines in FIG. 6. On changing light distribution pattern from low-beam mode to high-beam mode, the rotation axis 6*c* is rotated in a clockwise direction for a predetermined distance When the shading plate 6 is in the high-beam mode position, the first shading portion 6*a* is located away from luminous flux that converges from the first ellipse group reflecting surface 31L. Therefore, luminous flux that converges at the second focus $f2_{31}$ of the first ellipse group reflecting surface 31L travels to the first parabolic group reflecting surface 41L without being prohibited by the first shading portion 6*a*. At the same time, the second shading portion 6*b* is further away from luminous flax that converges from the second ellipse group reflecting surface 32L than when in its low-beam mode position. Therefore, substantially all luminous flux that converges at the second focus $f_{32}$ of the second ellipse group reflecting surface 32L travels to the second parabolic group reflecting surface 42L without any substantial portion of the luminous flux being prohibited by the second shading portion 6*b*.

Accordingly, light rays reflected by both the first parabolic group reflecting surface 41L and the second parabolic group reflecting surface 42L include upwardly directed light rays such that a high-beam mode light distribution pattern with long distance visibility is obtained.

In the vehicle light 1 of the preferred embodiment of FIG. 4, the shading plate 6 can be arranged to create a low or high beam light distribution for the left half (as viewed from behind the light source) of the vehicle light 1 relative to an illumination direction of the vehicle light 1. When the shading plate 6 is arranged in such a position, the right half of the vehicle light 1 can be designed to always provide low-beam mode light distribution.

Examples of modifications of the vehicle light 1 according to the preferred embodiment of FIG. 4 will now be described. Although not illustrated herein, the movable shading plate 6 may be arranged corresponding to the first ellipse group reflecting surface element 31R and the second ellipse group reflecting surface element 32R and on the right side of the vehicle light 1. Or otherwise, a pair of movable shading plates 6 may be arranged corresponding to the combinations of the first and second ellipse group reflecting surface elements (31L, 32L) and (31R, 32R) on either side of the vehicle light 1. When the pair of movable shading plates 6 are arranged, both shading plates 6 can be driven by a single driver.

In addition, on mode change of light distribution pattern of the vehicle light 1, the amount of rotational movement can be different between the first shading portion 6*a* and the second shading portion 6*b*. In such a case, it is possible to provide the appropriate amount of rotational movement to the first shading portion 6*a* and to the second shading portion 6*b* by adjusting the location of the rotation axis 6*c*.

In the preferred embodiment of FIG. 4, substantially all light rays directed from the first ellipse group reflecting surface element 31L to the first parabolic group reflecting surface element 41L are prohibited by the first shading portion 6*a* when in low-beam mode. However, it is possible to design the shading plate 6 such that substantially all light rays directed from the second ellipse group reflecting surface element 32L towards the second parabolic group reflecting surface element 42L are prohibited by the second shading portion 6*b* while the first shading portion 6*a* prohibits only unnecessary portions of luminous flux at the second focus $f2_{31}$ which travel towards the first parabolic group reflecting surface element 41L. Alternatively, the shading portion 6*a* or 6*b* which prohibits substantially all light rays at the second foci $f2_{31}$ or $f2_{32}$, of the ellipse group reflecting surface element 31R or 32R can be located on the right side of the vehicle light 1 relative to the optical axis X of the vehicle light 1. Furthermore, many combinations of the above-described modifications are also possible.

In addition to the operational advantages of the preferred embodiments of the present invention described above, the vehicle light 1 of the preferred embodiment of FIG. 4 has the following advantage. Since the vehicle light 1 can include a movable shading plate 6 which enables mode change of the light distribution pattern of the vehicle light 1 between low-beam and high-beam by changing the position of the movable shading plate 6, the number of light sources 2 may be minimized, e.g., a single light source 2 can be used. The structure of the vehicle light 1 requiring only one light source 2 is greatly effective for cost reduction when a high-intensity discharge lamp is used as the light source 2.

It should be understood that ellipse group and parabolic group refer to shapes that can include ellipses and parabolas, respectively, but are not limited to such configurations/shapes. For example, an ellipse group surface can include an ellipse like surface, a plurality of ellipse surfaces, a plurality of ellipse like surfaces, etc. Similarly, a parabolic group surface can include many variations of shapes. With regard to the shade disclosed above, several variations can be made to the preferred embodiments discussed above without departing from the spirit and scope of the invention. For example, the shade can be made from reflective, opaque and/or clear material depending on the extent of shaping of the light is desired. The shade can also be shaped to substantially close ends of the chamber formed by the ellipse group reflecting surfaces, or can provide large apertures at each end of the chamber defined by the ellipse group reflecting surfaces. Furthermore, the shade can be moved by rocking motion as shown, or can be formed to slide towards/away from the ellipse group reflecting surface.

It will be apparent to those skilled in the art that various changes and modifications can be made herein without departing from the spirit and scope of the invention. Thus, it is intended that the present invention cover the modifications and variations of the invention provided they come within the scope of the appended claims and their equivalents.

What is claimed is:

1. A vehicle lamp having a multi-reflex optical system and an optical axis, comprising:

a light source;

at least one pair of ellipse group reflecting surfaces, each ellipse group reflecting surface being substantially symmetrical relative to the light source and having a first focus in the vicinity of the light source, a second focus, and a longitudinal axis substantially perpendicular to the optical axis of the vehicle lamp;

two pairs of parabolic group reflecting surfaces, at least one of the parabolic group reflecting surfaces having a focus on the second focus of a corresponding ellipse group reflecting surface, and a longitudinal axis substantially parallel to the optical axis of the vehicle lamp; and at least one shade located in the vicinity of one of the second foci of the ellipse group reflecting surfaces to provide a predetermined shape to luminous flux directed from the corresponding ellipse group reflecting surface.

2. The vehicle lamp according to claim 1, wherein the shade includes a reflecting portion for directing light rays prohibited by the shade to at least one of the parabolic group reflecting surfaces.

3. The vehicle lamp according to claim 2, wherein the at least one shade is movable, and a light distribution pattern of the vehicle lamp is changed by movement of the shade.

4. The vehicle lamp according to claim 3, wherein the at least one shade includes a plurality of shades which are movable, and which are driven by a single driver.

5. The vehicle lamp according to claim 1, wherein the at least one shade is movable, and a light distribution pattern of the vehicle lamp is changed by movement of the shade.

6. The vehicle lamp according to claim 5, wherein the at least one shade includes a plurality of shades which are movable, and which are driven by a single driver.

7. The vehicle lamp according to claim 1, wherein the at least one shade includes a plurality of shades which are movable, and which are driven by a single driver.

8. The vehicle lamp according to claim 1, wherein the light source is a high-intensity discharge lamp without any black-stripe.

9. The vehicle lamp according to claim 1, wherein the light source is a D2S type high-intensity discharge lamp.

10. The vehicle lamp according to claim 1, wherein the number of parabolic group reflecting surfaces is equal to the number of ellipse group reflecting surfaces.

11. A vehicle lamp having a multi-reflex optical system and an optical axis, comprising:

a light source;

an ellipse group reflecting portion being substantially symmetrical relative to the light source and having a first focus in the vicinity of the light source, a second focus, and a longitudinal axis substantially perpendicular to the optical axis of the vehicle lamp;

a parabolic group reflecting portion having a focus on the second focus of the ellipse group reflecting portion, and a longitudinal axis substantially parallel to the optical axis of the vehicle lamp, the parabolic group reflecting portion including two parabolic group reflecting surfaces located on a same side of the light source; and a shade located in the vicinity of the second focus of the ellipse group reflecting portion to provide a predetermined shape to luminous flux directed from the ellipse group reflecting portion.

12. The vehicle lamp according to claim 11, wherein the shade includes a reflecting portion for directing light rays prohibited by the shade to the parabolic group reflecting portion.

13. The vehicle lamp according to claim 11, wherein the shade is movable, and a light distribution pattern of the vehicle lamp is changed by movement of the shade.

14. The vehicle lamp according to claim 11, wherein the ellipse group reflecting portion includes a plurality of ellipse group reflecting surfaces.

15. The vehicle lamp according to claim 11, wherein the parabolic group reflecting portion includes a plurality of parabolic group reflecting surfaces.

16. The vehicle lamp according to claim 11, wherein the ellipse group reflecting portion is located substantially within the parabolic group reflecting portion and forms a chamber from which light from the light source is directed to the parabolic group reflecting portion such that light is then directed parallel to the optical axis of the vehicle lamp.

17. A vehicle lamp having a multi-reflex optical system and an optical axis, comprising:

a light source;

an ellipse group reflecting portion being substantially symmetrical relative to the light source and having a first focus in the vicinity of the light source, a second focus, and a longitudinal axis substantially perpendicular to the optical axis of the vehicle lamp;

a parabolic group reflecting portion having a focus on the second focus of the ellipse group reflecting portion, and a longitudinal axis substantially parallel to the optical axis of the vehicle lamp, the parabolic group reflecting portion including two parabolic group reflecting surfaces located on a same side of the light source; and means located in the vicinity of the second focus of the ellipse group reflecting portion for providing a predetermined shape to luminous flux directed from the ellipse group reflecting portion.

18. The vehicle lamp according to claim 17, wherein the ellipse group reflecting portion is located substantially within the parabolic group reflecting portion and forms a chamber from which light from the light source is directed to the parabolic group reflecting portion such that light is then directed parallel to the optical axis of the vehicle lamp.

19. The vehicle lamp according to claim 17, wherein the means for providing a predetermined shape to luminous flux includes a shade.

* * * * *